US009651254B2

(12) United States Patent
Ducharme et al.

(10) Patent No.: US 9,651,254 B2
(45) Date of Patent: May 16, 2017

(54) MEASURING AND CONTROLLING FLAME QUALITY IN REAL-TIME

(71) Applicant: LumaSense Technologies Holdings, Inc., Santa Clara, CA (US)

(72) Inventors: David Ducharme, Santa Clara, CA (US); Kreg Kelley, Santa Clara, CA (US); Peter Hodgins, Santa Clara, CA (US)

(73) Assignee: LumaSense Technologies Holdings, Inc., Santa Clara, CA (US)

( * ) Notice: Subject to any disclaimer, the term of this patent is extended or adjusted under 35 U.S.C. 154(b) by 342 days.

(21) Appl. No.: 14/522,827

(22) Filed: Oct. 24, 2014

(65) Prior Publication Data

US 2016/0116164 A1 Apr. 28, 2016

(51) Int. Cl.

| | |
|---|---|
| ***F23L 7/00*** | (2006.01) |
| ***F23N 5/00*** | (2006.01) |
| ***F23N 5/26*** | (2006.01) |

(52) U.S. Cl.

CPC ..... *F23N 5/003* (2013.01); *F23L 7/005* (2013.01); *F23N 5/265* (2013.01); *F23N 2029/20* (2013.01); *F23N 2037/22* (2013.01)

(58) Field of Classification Search

CPC ..... F23N 5/003
USPC ..... 431/14, 75
See application file for complete search history.

(56) References Cited

U.S. PATENT DOCUMENTS 5,794,549 A * 8/1998 Carter ..... F23M 11/045 110/185
5,797,736 A * 8/1998 Menguc ..... F23N 5/08 110/185

OTHER PUBLICATIONS

Notification of Transmittal of the International Search Report and the Written Opinion for corresponding International Application No. PCT/US2015/056645, mailed Feb. 11, 2016 (2 page).
International Search Report in corresponding application No. PCT/US2015/056645 mailed Feb. 11, 2016 (3 pages).
Written Opinion in corresponding application No. PCT/US2015/056645 mailed Feb. 11, 2016 (9 pages).

* cited by examiner

*Primary Examiner* — Avinash Savani
(74) *Attorney, Agent, or Firm* — Osha Liang LLP

(57) ABSTRACT

A method for measuring and controlling flame quality in real-time, the method comprising the steps of: acquiring a plurality of flame images in a first field of view; acquiring a plurality of flame images in a second field of view; processing the acquired plurality of flame images of said first and second fields of view to determine an overall flame quality parameter; and comparing the overall flame quality parameter to a tolerance range. In other aspects, a system for measuring and controlling flame quality in real-time and a non-transitory computer readable medium (CRM) storing instructions configured to cause a computing system to measure and control flame quality in real-time are provided.

32 Claims, 4 Drawing Sheets

MEASURING AND CONTROLLING FLAME QUALITY IN REAL-TIME

BACKGROUND

Gas flares are used in several industries, among them petrochemical plants, natural gas processing, oil wells and landfills. One purpose of gas flares is to safely and cleanly dispose of gases arising from sudden and abnormal process conditions. Such abnormal process conditions could be, for example, the result of a plant emergency or maintenance Another purpose of gas flares is to serve as temporary measure during well production testing. Typically gas flares are implemented as elevated flare stacks for safety reasons and to comply with emissions regulations. A small pilot flame is continually operated near the top of the elevated flare stack to insure that the gas flare system will be functional in the event that gas is to be disposed.

Environmental regulations limit the emissions and particulates from gas flares. Therefore it is important that the burning of the flare flame is maintained in an efficient manner to minimize by-products, for example, black smoke. Black smoke is produced by a flare flame when the oxygen access to the flame is impaired and complete combustion is prevented. One method to improve the flare flame's access to oxygen is to inject steam into the flame. The injection of steam allows surrounding air to be intermixed with the interior of the flame resulting in a more complete combustion and suppression of black smoke. However, if too much steam is injected into the flare flame, a condition referred to as "over-steaming" results, during which the combustion efficiency declines and volatile organic compounds (VOCs) are potentially released into the environment.

The monitoring of the combustion efficiency of the flare flame is typically performed by a trained operator and in the event of black smoke appearing from the flare flame, the operator opens a steam valve to maintain an efficient combustion as described above. It would be advantageous if there was a method, a system, and a non-transitory computer readable medium for measuring and controlling flame quality in real-time.

SUMMARY OF CLAIMED EMBODIMENTS

In general, in one aspect, one or more embodiments disclosed herein relate to a method for measuring and controlling flame quality in real-time. The method may include: acquiring a plurality of flame images in a first field of view; acquiring a plurality of flame images in a second field of view; processing the acquired plurality of flame images of said first and second fields of view to determine an overall flame quality parameter; and comparing the overall flame quality parameter to a tolerance range.

In another aspect, one or more embodiments disclosed herein relate to a system for measuring and controlling flame quality in real-time. The system may include a first camera for acquiring a plurality of flame images in a first field of view; a second camera for acquiring a plurality of flame images in a second field of view; a processing unit for processing the acquired plurality of flame images of said first and second fields of view to determine an overall flame quality parameter; and a control module for comparing the overall flame quality parameter to a tolerance range.

In yet another aspect, one or more embodiments disclosed herein relate to a non-transitory computer readable medium (CRM) storing instructions configured to cause a computing system to measure and control flame quality in real-time.

The instructions stored by the non-transitory computer readable medium may include functionality for: processing a plurality of flame images corresponding to first and second fields of view to determine an overall flame quality parameter; and comparing the overall flame quality parameter to a tolerance range.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In general, embodiments of the invention relate to multi-spectral imaging of a flare flame through the use of different optically filtered cameras. Following is a detailed description of specific embodiments disclosed herein with reference to the Figures. In these Figures, several details are presented to further the understanding of the disclosed embodiments. However, these details may not be required or could be substituted for other details as would be known to one with ordinary skill in the art. In addition, other well-known features have not been described as not to distract from the description of the disclosed embodiments.

Figure 1:
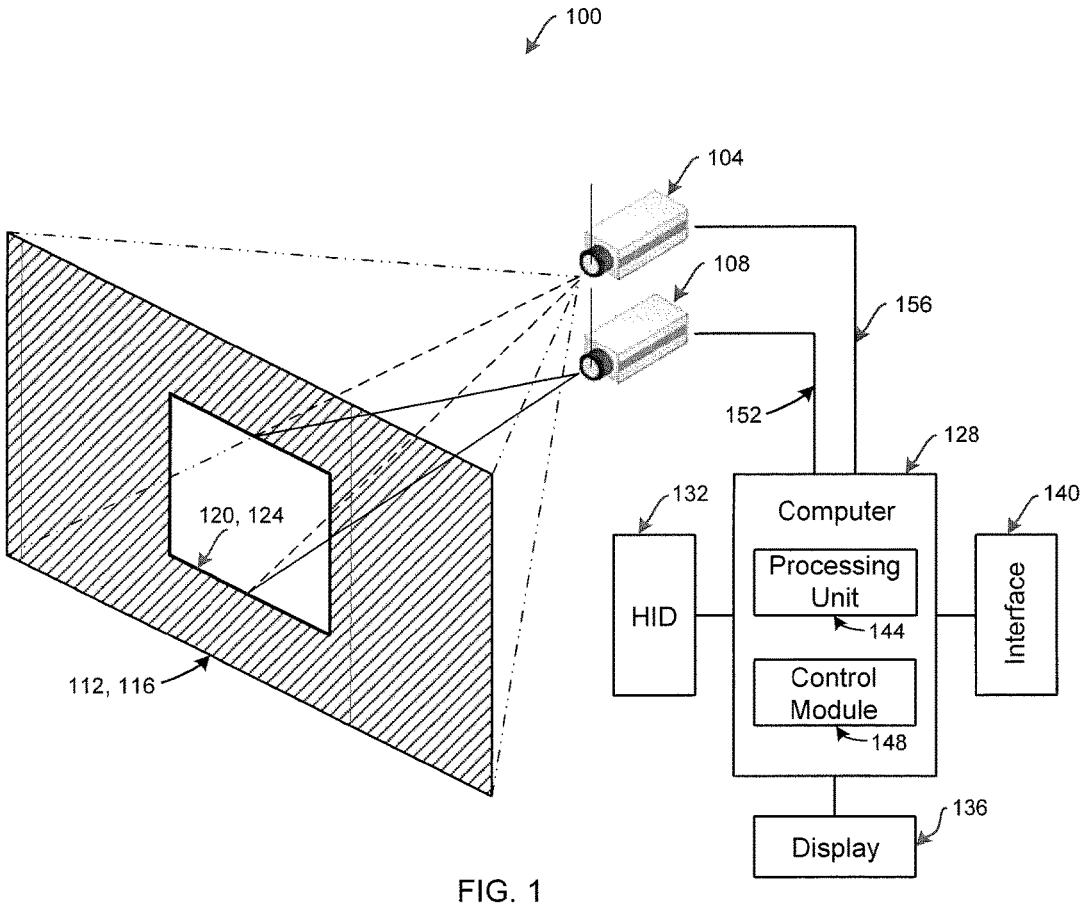
FIG. 1 shows a system for measuring and controlling flame quality in real-time in accordance with one or more embodiments disclosed herein.

In one aspect, embodiments disclosed herein relate to a system for measuring and controlling flame quality in real-time. FIG. 1 shows an exemplary system 100 for measuring and controlling flame quality in real-time. The system 100 may include a first camera 104 and a second camera 108 pointed in the direction of a flare flame (not shown) from an elevated flare stack. The first camera 104 may include a first filter and a first sensor (both not shown). Similarly, the second camera 108 may include a second filter and a second sensor (both not shown). The first and second sensors may be infrared sensors and are also referred to as infrared imagers, or more specifically as microbolometers. The microbolometers may use materials, e.g. vanadium oxide, germanium, indium gallium arsenide, lead sulfite, lead selenide, mercury cadmium telluride, or combinations thereof. Other embodiments may use different materials or combinations of materials for the first and second infrared sensors. In some embodiments, the first camera 104 is substantially in the same plane as the second camera 108, but offset from each other in one direction. Other embodiments may include offsetting the first camera 104 and the second camera 108 from each other in more than one direction. In one or more embodiments, the offset from the first camera 104 to the second camera 108 may be less than one meter. In other embodiments, the offset from the first camera 104 to the second camera 108 may be larger than one meter. Alternate embodiments may include more than two cameras to acquire a plurality of images of the flare flame. In yet other embodiments, the flare flame may be emitted from a non-elevated flare stack.

The first camera 104 has a first field of view 112 which encompasses the flare flame and is able to acquire a plurality of flame images in the first field of view 112. The first field of view 112 is located perpendicularly to the optical axis of the first camera 104 at a distance away from the first camera 104. The second camera 108 has a second field of view 116 which encompasses the same flare flame from the elevated flare stack referred to above and is also able to acquire a plurality of flame images in the second field of view 116. The second field of view 116 is located perpendicularly to the optical axis of the second camera 108 at a distance away from the second camera 108.

In the exemplary embodiment in FIG. 1, the first field of view 112 may be substantially in the same plane and substantially the same size as the second field of view 116. However, alternate embodiments may include a first field of view 112 and a second field of view 116 which differ in size and/or include offset planes. The field of view of each camera may be enlarged by increasing the distance between each camera and the flare flame. An optimum distance between each camera and the flare flame is between a minimum and a maximum distance. The minimum distance is determined by that the flare flame must be fully within the field of view of a camera during all wind conditions and for all expected flame sizes. The maximum distance is determined by that the flare flame image projected on the sensor of each camera should be larger than about 5% of the active sensor area. That is, because even though the field of view increases with increasing distance between the camera and the flare flame, the actual image of the flare flame projected onto the sensor actually decreases in size. In one or more embodiments, the distance between each camera and the flare flame may be between 50 and 100 meters. In other embodiments, the distance between each camera and the flare flame may be less than 50 meters. In yet other embodiments, the distance between each camera and the flare flame may be more than 100 meters.

The acquisition of the plurality of flame images in a first and a second field of view 112, 116 may require substantial storage space and computing capability, therefore it may be beneficial to reduce the acquired plurality of flame images to a size which still contains the required information. Further, a reduction of the acquired plurality of flame images may be beneficial in minimizing the effect of stray radiance, i.e. the reflection of radiance from structures within the fields of view of the first camera 104 and the second camera 108. Accordingly, within the first field of view 112 of the first camera 104, there is a first region of interest 120, which is smaller than the first field of view 112. Similarly, within the second field of view 116 of the second camera 108, there is also a second region of interest 124, which is smaller than the second field of view 116. Generally, the sizes of the regions of interest for each respective camera are based on the expected size of the flare flame, wind speed, and wind direction.

In some embodiments, the first camera 104 may be a mid-wave infrared (MWIR) camera, for example a LumaSense™ MC320F thermal imager. In other embodiments, the first camera 104 may be a different MWIR camera model. The MWIR camera may include a 3.9 μm mid-wave infrared (MWIR) band pass filter. Typically, an MWIR band pass filter may be constructed using a substrate, e.g. germanium, silicon, sapphire, quartz, calcium fluoride, etc. and depositing a multilayer interference coating on the substrate. However, it is understood that MWIR band pass filters may also be constructed by alternate processes. The 3.9 μm band pass filter allows radiance of a flare flame to pass through the filter in a relatively narrow wavelength range centered around the band pass filter wavelength. For example the 3.9 μm band pass filter may pass radiance of a flare flame wavelength from 3.8 μm to 4.0 μm, e.g. +/−100 μm around the center wavelength. For the purposes of this description, radiance is defined as radiance of visible or non-visible light emitted by the flare flame. This radiance may range from the visible radiance of a few hundred nanometers in wavelength to invisible short-wave infrared (SWIR), mid-wave infrared (MWIR), long-wave infrared (LWIR), and to more than 15 μm wavelength and beyond. The radiance from a flare flame is composed of several contributors, among them radiance from gaseous components, e.g. soot, water, carbon monoxide and carbon dioxide. Specifically, the relatively narrow band pass filter of 3.9 μm mainly passes radiance from soot emitted by the flare flame with very little contribution to the radiance from water, carbon monoxide or carbon dioxide.

In some embodiments, the second camera 108 in FIG. 1 may be a long-wave infrared (LWIR) camera, for example a LumaSense™ MC320LHTE thermal imager. In other embodiments, the second camera 108 may be a different LWIR camera model. The LWIR camera may include an 8-14 μm long-wave infrared (LWIR) long pass filter. The long pass filter starts passing radiance of a flare flame at a defined wavelength and continues to pass radiance at longer wavelengths than the defined wavelength. Specifically, the 8-14 μm long pass filter passes emitted flare flame radiance starting at about 8 μm and continues to pass flare flame radiance until about 14 μm. Often, the longer wavelength limit of a long pass filter is determined by the property of the substrate material of the filter, which may be, germanium, zinc selenide, etc. With regard to the system 100 for measuring and controlling flame quality in real-time, the 8-14 μm long pass filter transmits a substantial contribution to the radiance from water and some contribution to the radiance from soot. In comparison to the 3.9 μm band pass filter described above, the 8-14 μm long pass filter transmits radiance from soot to a slightly lesser degree. Further, it is understood that other embodiments disclosed herein may utilize alternate types of filters with wavelength ranges different from those described above, without departing from the scope of the present disclosure. In yet other embodiments disclosed herein, the cameras may be interchanged, e.g. the first camera 104 may be a long-wave infrared (LWIR) camera and the second camera 108 may be the mid-wave infrared (MWIR) camera. Also, in yet other embodiments, a third or more cameras may be installed, either for redundancy or to capture other regions of interest.

FIG. 1 illustrates that the first camera 104 and the second camera 108 may be connected to a computer 128 having a processing unit 144. The respective connections 152, 156 are for transferring acquired flare flame image data by the cameras into the computer 128. In some embodiments, the connections 152, 156 of the first camera 104 and the second camera 108 to the processing unit 124 of the computer 128 may include a physical connection utilizing wires or optic fibers. However, in other embodiments disclosed herein, the connections 152, 156 may include a wireless transmission/reception of information between cameras 104 and 108 and the processing unit 144 of the computer 128. In yet other embodiments disclosed herein, the connections 152, 156 described above may include a combination of wired and wireless connection types.

The computer 128 may also include a control module 148 which may be software or hardware. In the exemplary embodiment of FIG. 1, the control module 148 may be implemented as software. Alternatively, the control module 148 could be implemented as hardware, e.g. as a programmable logic device (PLD), or yet another hardware solution. In some embodiments, the system 100 may further include an interface 140 for connection to a control valve (not shown) in order for the control module 148 to control an additive, such as steam, into the flare flame. In FIG. 1, the interface 140 is implemented as a wired connection between the system 100 for measuring and controlling flame quality in real-time and the control valve, however, other embodiments may utilize a wireless connection or a combination between a wired and a wireless connection to pass information between the system and the control valve. Further, additives other than steam may be controlled into the flare flame without departing from the scope of the disclosed embodiments herein.

Referring again to FIG. 1, in one or more embodiments disclosed herein, the system 100 may include a human interface device (HID) 132 for entry of user-defined values and an output display 136. The human interface device 132 could be, for example, a keyboard, a keypad, a mouse, or combinations thereof. Alternatively, the human interface device 132 could be implemented as motion or gesture-tracking device. Further, the human interface device 132 and the output display 136 could be realized in a combination, for example as a touchscreen. However, the disclosed embodiments are not limited to using the described human interface devices for entering user-defined values. Similarly, the disclosed embodiments are not limited to using the described output devices recited above.

Figure 2:
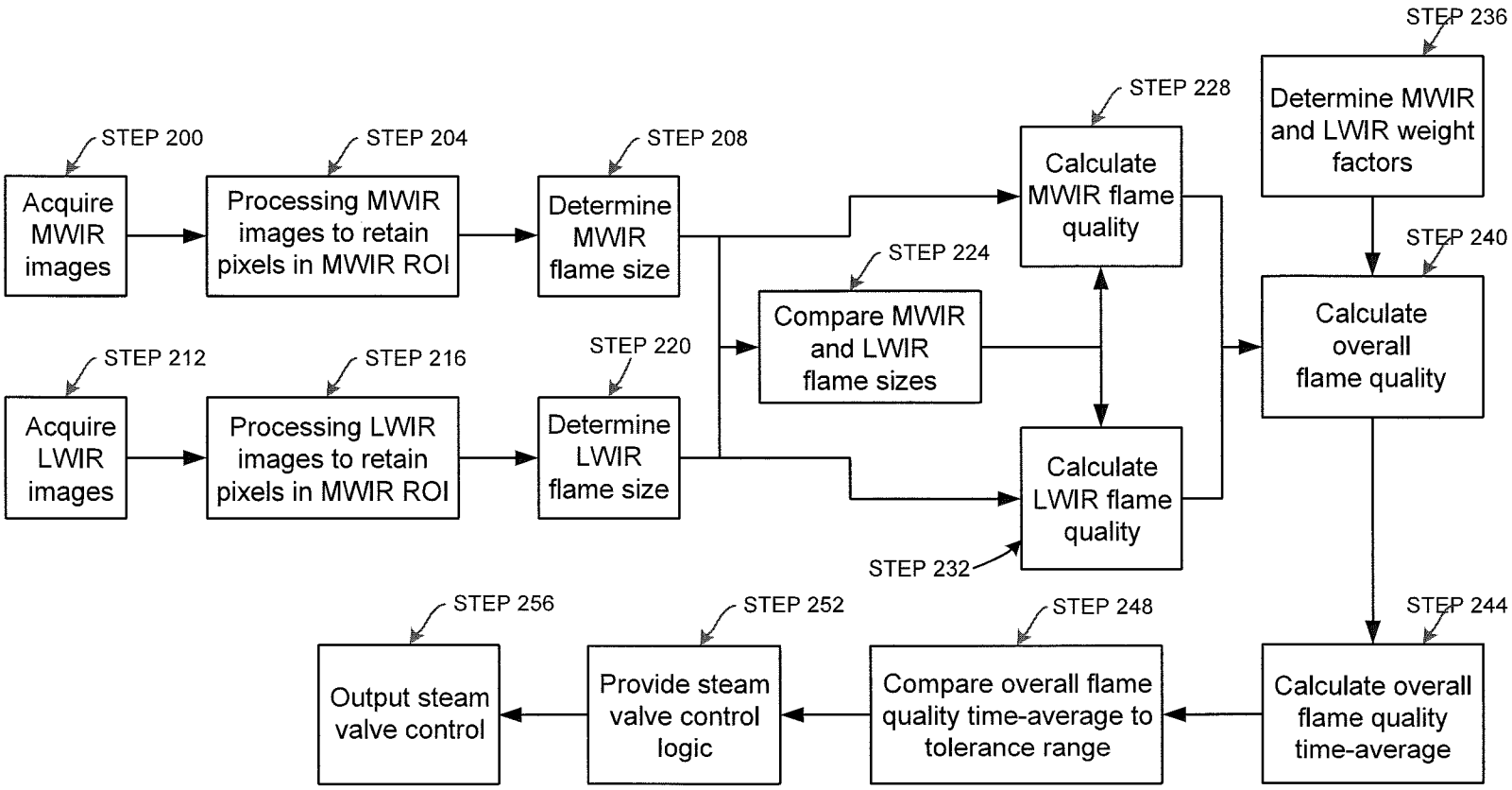
FIG. 2 illustrates a flowchart for a method for measuring and controlling flame quality in real-time in accordance with one or more embodiments disclosed herein.

FIG. 2 shows an embodiment of a flow chart for a method for measuring and controlling flame quality in real-time. Other embodiments may include measuring and controlling flame quality in real-time for multiple simultaneous flare flames from multiple flare flame nozzles. The method in FIG. 2 includes a step 200 of acquiring a plurality of flame images in a first field of view. This may be done by first camera 104. Similarly, the method in FIG. 2 further includes a step 212 of acquiring a plurality of flame images in a second field of view. This may be done by second camera 108. The plurality of flame images in a first field of view acquired by the MWIR camera in step 200 and the plurality of flame images in a second field of view acquired by the LWIR camera in step 212 may be stored for further use.

In some embodiments, an operator may initially choose a first region of interest within the first field of view which is smaller than the first field of view. Similarly, the operator may initially choose a second region of interest within the second field of view which is smaller than the second field of view. However, in other embodiments, the regions of interest within their respective field of view may be selected to be the same size as their respective field of view. Accordingly, in step 204 in FIG. 2, the acquired plurality of flame images of the first field of view 112 are processed by the processing unit 144 to retain a subset of pixels of a first region of interest (MWIR ROI) 120 within the first field of view. The pixels outside the first region of interest are discarded. Similarly, in step 216, the acquired plurality of flame images of the second field of view 116 are processed by the processing unit 144 to retain a subset of pixels to retain a subset of pixels of a second region of interest (LWIR ROI) 124 within the second field of view. The pixels outside the second region of interest are discarded.

In some embodiments, the plurality of images in the first and second fields of view are stored in the computer 128. In alternate embodiments, the plurality of images may temporarily be stored in the cameras 104, 108 before being transferred to the computer 128. Storing of acquired images is done digitally, for example, by storing as a pixmap, i.e. a spatially mapped array of pixels. Each pixel is stored according to an analog-to-digital converted (ADC) value of the collected radiance on that particular pixel. In some embodiments, an operator initially chooses a threshold value, which the ADC value of the collected radiance of each pixel must exceed in order to be retained for further calculations. If a pixel ADC value does not exceed this threshold value, the pixel value is set to zero and/or the specific pixel is excluded from further calculations.

Accordingly, in step 208 of FIG. 2, the processing unit 144 determines the number of pixels in the first region of interest 120, for which the pixel values are larger than a set threshold value (MWIR threshold). Similarly, in step 220, the processing unit 144 determines the number of pixels in the second region of interest 124, for which the pixel values are larger than a set threshold value (LWIR threshold). In the exemplary embodiment in FIG. 2, the set MWIR and LWIR threshold values are the same, however, in other embodiments, the MWIR and LWIR threshold values may differ. In general, the selection of optimum threshold values is determined such that the remaining pixels which are above the respective set threshold value effectively reflect the flare flame size as seen through the respective camera within the respective region of interest.

Specifically, the remaining pixels of the plurality of images from the first MWIR camera are intended to reflect the size of the flare flame based on the contribution of soot to the radiance. This is because, as described above, the relatively narrow band pass filter of 3.9 μm mainly passes radiance from soot emitted by the flare flame with very little contribution to the radiance from water, carbon monoxide or carbon dioxide. Similarly, the remaining pixels of the plurality of images from the second LWIR camera are intended to reflect the size of the flare flame based mainly on the contribution of water to the radiance. This is because, as discussed above, the 8-14 μm long pass filter passes a substantial contribution to the radiance from water and some contribution to the radiance from soot.

Figure 3A:
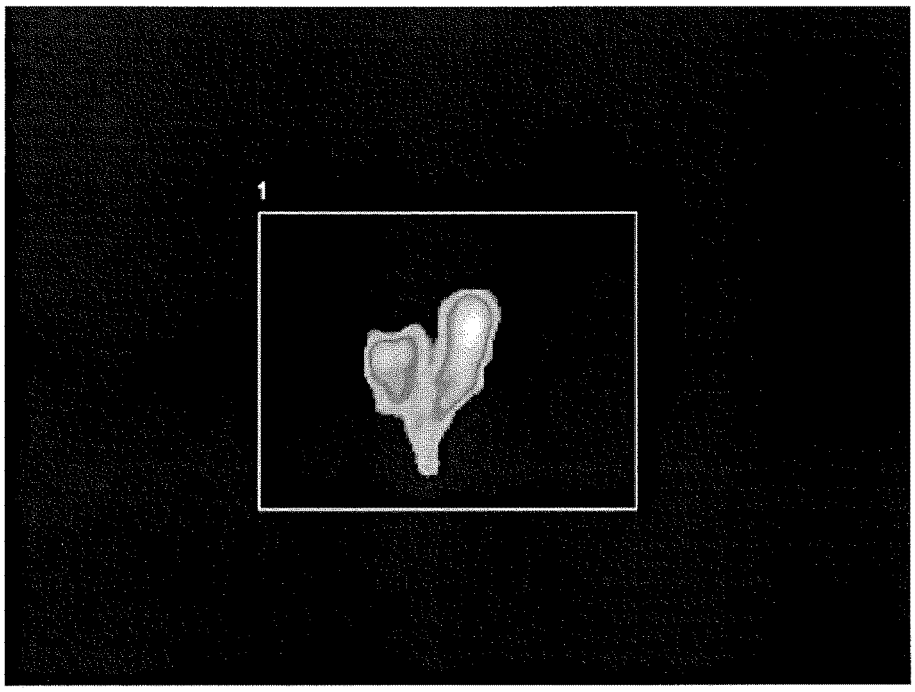
FIG. 3A shows an example of pixels of a flame image in the first region of interest that are above a set threshold value.
Figure 3B:
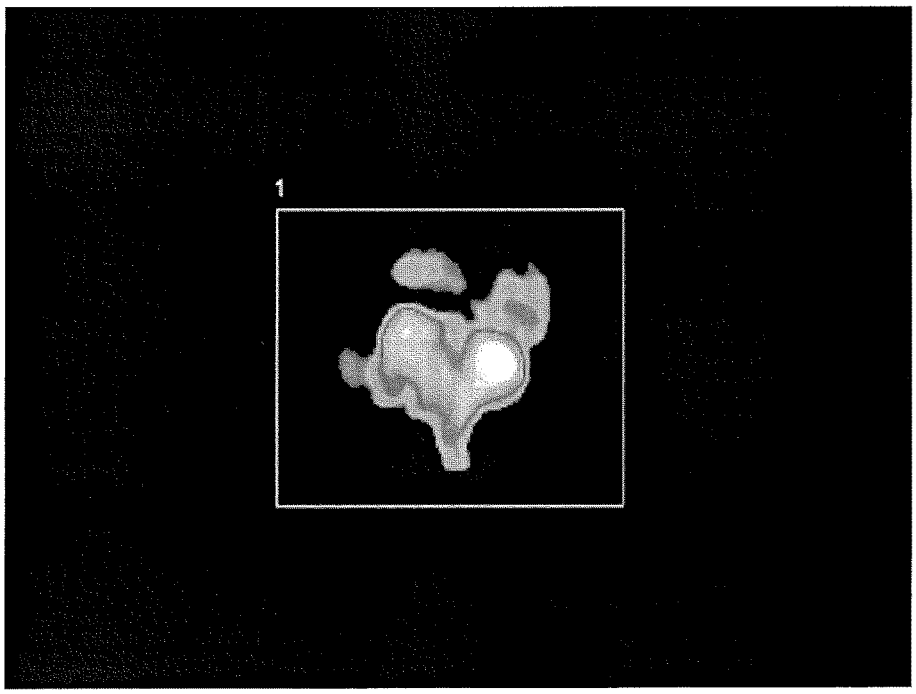
FIG. 3B shows an example of pixels of a flame image in the second region of interest that are above a set threshold value.

FIG. 3A shows an image for an exemplary embodiment containing only the pixels in the region of interest of a MWIR camera which are above the set MWIR threshold value. Further, FIG. 3B shows an image for an exemplary embodiment containing only the pixels in the region of interest of an LWIR camera which are above the set LWIR value. Black pixels in FIG. 3A and FIG. 3B represent pixels below the respective threshold value. In other words only what is shown is above the respective threshold value. Further, the respective box in FIG. 3A and FIG. 3B represents the respective region of interest. As discussed above, the determined number of pixels above the respective threshold value, reflect the flare flame size as seen through the respective camera within the respective region of interest. Therefore, the determined number of pixels associated with the MWIR camera (first camera 104) will be referred to in the following as "MWIR flame size" while the determined number of pixels associated with the LWIR camera (second camera 108) will be referred to in the following as "LWIR flame size."

Referring again to FIG. 2, once the MWIR flame size in step 208 and the LWIR flame size in step 220 are determined, the MWIR and LWIR flame sizes are compared in step 224 by the processing unit 144. With the results of this comparison and the MWIR flame size, the processing unit 144 calculates the MWIR flame quality in step 228. Similarly, with the results of this comparison and the LWIR flame size, the processing unit 144 calculates the LWIR flame quality in step 232. In some embodiments, proper initial conditions may be selected by the method to accurately calculate the respective MWIR and LWIR flame quality in step 228 and step 232. Specifically, proper initial conditions may be selected by the method for determined flare flame sizes, because the flare flame changes its size throughout the day or from location to location. Further, proper initial conditions may be selected for a flare flame during an over-steam condition, when too much steam has been added to the flare flame. In the case of an over-steam condition, the determined LWIR flame size is much larger than the determined MWIR flame size.

The initial conditions selected in some embodiments are derived by acquiring the MWIR and LWIR flame sizes for multiple "known" flare flame conditions. For example, the MWIR and LWIR flame sizes are calculated for intentionally clean and intentionally dirty flames of different sizes. Then, the standard deviation of the MWIR and LWIR flame sizes at each known flare flame condition (clean/dirty/small/large) is normalized and linearized, thereby providing initial conditions. Specifically, initial conditions m and b may be determined from the linearization based on the slope and y-axis intersection, respectively. In this context, the term "initial conditions" is equivalent to "reference conditions" or "calibration conditions." In some embodiments, the derivation of the initial conditions needs to be executed just once.

Once the initial conditions are established, the MWIR flame quality is calculated by the processing unit 144 in step 228 by averaging the standard deviation of the MWIR flame size over a time interval of one second. Next, the averaged standard deviation is inserted together with the initial conditions m and b, which were derived previously, into Equation (1) to determine the MWIR flame quality (i=MWIR).

$$\text{Channel Flame Quality}(i)=m(i)*StDev(i)+b(i) \quad (1)$$

Similarly, the LWIR flame quality is calculated by the processing unit 144 in step 232 of FIG. 2 by averaging the standard deviation of the LWIR flame size over a time interval of one second. Then, the averaged standard deviation is inserted together with the initial conditions m and b, which were derived previously, into Equation (1) to determine the LWIR flame quality (i=LWIR). While the exemplary embodiment described with respect to FIG. 2 refers to averaging the standard deviation of the apparent flame size over a time interval of one second, other embodiments may include averaging the standard deviation over a time interval other than one second.

Referring to FIG. 2, an overall flame quality parameter is calculated by the processing unit 144 in step 240 according to Equation (2). The overall flame quality parameter represents an overall measure for how efficient the flare flame is being operated. Calculated values for the overall flame quality parameter may range between numerical values of 0.0 (0%) and 1.0 (100%). Other embodiments may calculate numerical overall flame quality parameter values which are outside this range. In Equation (2), i=1 refers to MWIR and i=2 refers to LWIR. The WeightFactor(1) and WeightFactor (2) in Equation (2) are weight factors for MWIR and LWIR determined by the operator and are represented in FIG. 2 in step 236. For the purpose of this description, the term "operator" is interchangeable with the term "user."

$$\text{Overall Flame Quality}=\Sigma_{i=1}^{2}\text{Channel Flame Quality}(i)*\text{WeightFactor}(i) \quad (2)$$

Further, in step 244, the overall flame quality parameter is time-averaged over a user-defined time interval. In some embodiments, the user-defined time interval is about several seconds long, such as 10-300 seconds in some embodiments, 10-75 seconds in other embodiments, 25-150 seconds in other embodiments, and 50-300 seconds in yet other embodiments; however, other embodiments may utilize a user-defined time interval lesser than or greater than 10 and 300 seconds, respectively. In the exemplary embodiment of FIG. 2, the time-average is obtained by temporarily storing the values for the overall flame quality parameter during the user-defined time interval and the average is calculated from the batch of stored values. Other embodiments may calculate the time-average as a running average of the overall flame quality parameters based on the user-defined time interval.

The time-averaged overall flame quality parameter is compared to a tolerance range by the control module 148 in step 248 of FIG. 2. As an example, the tolerance range may be +/−0.1 (+/−10%) around a goal value of 0.7 (70%). Based on the comparison of the time-averaged overall flame quality parameter to the tolerance range, the control module 148 controls an amount of an additive into the flare flame via a control valve. In the exemplary embodiment in FIG. 2, the additive may be steam and step 252 refers to providing a steam valve control logic which contains an algorithm which considers different operation conditions. During one operating condition, the time-averaged overall flame quality parameter is higher than the goal value and outside the tolerance range. As a result, the steam valve is closed incrementally based on a user-defined steam valve step size parameter. During another operating condition, the time-averaged overall flame quality parameter is higher or lower than the goal value, but within the tolerance range. As a result, the steam valve is not adjusted. Consequently, the purpose of the tolerance range is to provide a range, where no adjustment to the steam valve is necessary. Therefore, the tolerance range reduces the wear on the steam valve and prevents potential ringing, i.e. an unintended oscillatory behavior of the control loop. During yet another operating condition, the time-averaged overall flame quality parameter is lower than the goal value and outside the tolerance range. As a result, the steam valve is opened incrementally based on a user-defined steam valve step size parameter. In the exemplary embodiment in FIG. 2, the user-defined steam valve step size parameter is the same for opening or closing the steam valve. However, in other embodiments, the user-defined steam valve step size parameter may be different for opening and closing of the steam valve.

In the exemplary embodiment in FIG. 2, step 256 refers to the steam valve control output from the control module 148. In accordance with the interface 140 in FIG. 1, the steam valve control output is the transfer of control information from step 252 to the steam valve. In the exemplary embodiment in FIGS. 1 and 2, the control algorithm is provided in the control module 148 and the interface 140 is connected to the steam valve (not shown). However, in other embodiments, the control module may output an analog signal proportional to the time-averaged overall flame quality parameter through the interface 140. Then an external physical controller, which in turn is connected to the interface and the steam valve, acts upon this analog signal to control the steam valve. The external physical controller may include a dead band to prevent ringing. In any case, it is beneficial to tune the control algorithm, whether implemented in the control module 148 or in an external controller, for each application because of differing steam pressures, differing piping lengths, valve response times, etc. at each application site.

Figure 4:
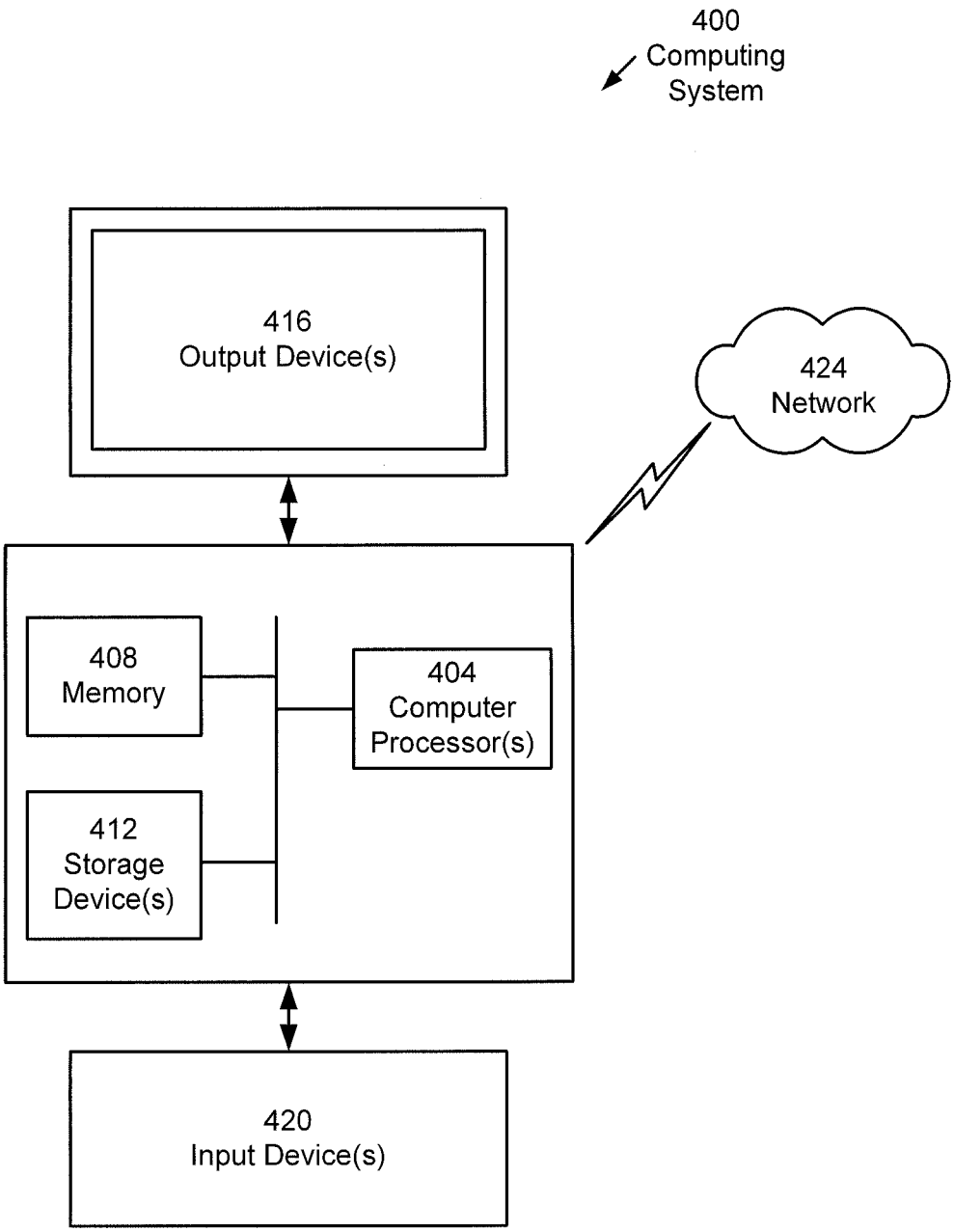
FIG. 4 shows a computer system in accordance with one or more embodiments of the invention.

In another aspect, embodiments disclosed herein relate to a non-transitory computer readable medium (CRM) storing instructions configured to cause a computing system to measure and control flame quality in real-time. Accordingly, embodiments of the invention may be implemented on virtually any type of computer regardless of the platform being used. For example, as shown in FIG. 4, a computer system 400 includes one or more processor(s) 404 (such as a central processing unit (CPU), integrated circuit, etc.), associated memory 408 (e.g., random access memory (RAM), cache memory, flash memory, etc.), a storage device 412 (e.g., a hard disk, a solid state memory drive (SSD), an optical drive such as a compact disk drive or digital video disk (DVD) drive, a flash memory stick, etc.), and numerous other elements and functionalities typical of today's computers (not shown). The computer system 400 may also include input means 420, such as a keyboard, a mouse, or a microphone (not shown). Further, the computer system 400 may include output means, such as a monitor 416 (e.g., a liquid crystal display (LCD), a plasma display, or cathode ray tube (CRT) monitor). The computer system 400 may be connected to a network 424 (e.g., a local area network (LAN), a wide area network (WAN) such as the Internet, or any other type of network) via a network interface connection (not shown). Those skilled in the art will appreciate that many different types of computer systems exist, and the aforementioned input and output means may take other forms. Generally speaking, the computer system 400 includes at least the minimal processing, input, and/or output means necessary to practice embodiments of the invention.

Further, in one or more embodiments of the invention, one or more elements of the aforementioned computer system 400 may be located at a remote location and connected to the other elements over a network. Further, embodiments of the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor or micro-core of a processor with shared memory and/or resources. Further, software instructions in the form of computer readable program code to perform embodiments of the invention may be stored, temporarily or permanently, on a tangible computer readable storage medium, such as a compact disc (CD), a diskette, a solid state memory device (SSD), a tape, memory, or any other non-transitory tangible computer readable storage device.

In addition, one or more embodiments of the invention may be realized in an embedded computer system. Further, one or more embodiments of the invention may be realized in an erasable programmable read only memory (EPROM), programmable logic device (PLD) or in yet other hardware solutions.

While the disclosed embodiments have been described with respect to a limited number of embodiments, those skilled in the art will readily appreciate that many modifications are possible in the example embodiments without materially departing from this invention. Accordingly, all such modifications are intended to be included within the scope of this disclosure as defined in the following claims.

What is claimed:

1. A system for measuring and controlling flame quality in real-time, the system comprising:

a first camera for acquiring a plurality of flame images in a first field of view;

a second camera for acquiring a plurality of flame images in a second field of view;

a processing unit for processing the acquired plurality of flame images of said first and second fields of view to determine an overall flame quality parameter; and a control module for comparing the overall flame quality parameter to a tolerance range, wherein the first and second cameras are connected to the processing unit.

2. The system according to claim 1, wherein the first camera comprises a 3.9 μm band pass filter.

3. The system according to claim 1, wherein the second camera comprises an 8-14 μm long pass filter.

4. The system according to claim 1, wherein the first camera is located substantially in the same plane as the second camera but offset from each other.

5. The system according to claim 1, wherein the first field of view is substantially in the same plane and substantially the same size as the second field of view.

6. The system according to claim 1, wherein the connection is at least one of wireless, wired, and combinations thereof.

7. The system according to claim 1, further comprising a human interface device for entry of user-defined values and an output display device.

8. The system according to claim 1, wherein the control module for comparing the overall flame quality parameter to a tolerance range comprises software.

9. The system according to claim 1, wherein the control module is further configured to modify the overall flame quality parameter by controlling an amount of an additive into the flame.

10. The system according to claim 9, wherein the additive comprises steam.

11. The system according to claim 1, further comprising an interface for connection to a control valve for controlling an amount of an additive into the flame.

12. The system according to claim 11, wherein the interface is at least one of wireless, wired, and combinations thereof.

13. A method for measuring and controlling flame quality in real-time, the method comprising the steps of:

acquiring a plurality of flame images in a first field of view;

acquiring a plurality of flame images in a second field of view;

processing the acquired plurality of flame images of said first and second fields of view to determine an overall flame quality parameter; and comparing the overall flame quality parameter to a tolerance range, wherein processing the acquired plurality of flame images of the first and second fields of view comprises selecting a region of interest of the first field of view and a region of interest of the second field of view, wherein the region of interest is smaller than the respective field of view.

14. The method according to claim 13, wherein acquiring the plurality of flame images in a first field of view comprises capturing flame images in a first field of view and storing the first field of view flame images.

15. The method according to claim 13, wherein acquiring the plurality of flame images in a second field of view comprises capturing flame images in a second field of view and storing the second field of view flame images.

16. The method according to claim 13, wherein the first field of view is substantially in the same plane and substantially the same size as the second field of view.

17. The method according to claim 13, wherein processing the acquired plurality of flame images of the first and second fields of view further comprises selecting pixels of flame images in the first region of interest and second region of interest that are above a set threshold value.

18. The method according to claim 13, wherein processing the acquired plurality of flame images of the first and second fields of view further comprises calculating a flame quality for the first region of interest and a flame quality for the second region of interest by multiplying a first parameter for each respective region of interest with the standard deviation of pixels that are above a set threshold value for each respective region of interest and adding a second parameter for each respective region of interest.

19. The method according to claim 18, wherein processing the acquired plurality of flame images of the first and second fields of view further comprises calculating the overall flame quality parameter by summing up the products of the flame quality for each respective region of interest and a weight factor for each respective region of interest.

20. The method according to claim 13, wherein processing the acquired plurality of flame images of said first and second fields of view further comprises comparing the number of pixels that are above a set threshold value of the first region of interest, to the number of pixels that are above the set threshold value of the second region of interest.

21. The method according to claim 13, wherein the overall flame quality parameter is time-averaged over a user-defined time interval.

22. The method according to claim 13, wherein comparing the overall flame quality parameter to a tolerance range further comprises modifying the overall flame quality parameter by controlling an amount of an additive into the flame based on a control algorithm comprising at least, a user-defined control valve step size parameter for the additive.

23. The method according to claim 22, wherein the additive comprises steam.

24. A non-transitory computer readable medium (CRM) storing instructions configured to cause a computing system to measure and control flame quality in real-time, the instructions comprising functionality for:

processing a plurality of flame images corresponding to first and second fields of view to determine an overall flame quality parameter;

comparing the overall flame quality parameter to a tolerance range; and time-averaging the overall flame quality parameter over a user-defined time interval.

25. The non-transitory CRM according to claim 24, further comprising instructions for acquiring the plurality of flame images in a first field of view and storing the first field of view flame images.

26. The non-transitory CRM according to claim 24, further comprising instructions for acquiring the plurality of flame images in a second field of view and storing the second field of view flame images.

27. The non-transitory CRM according to claim 24, further comprising instructions for selecting a region of interest of the first field of view and a region of interest of the second field of view, wherein the region of interest is smaller than the respective field of view.

28. The non-transitory CRM according to claim 27, further comprising instructions for selecting pixels of flame images in the first region of interest and second region of interest that are above a set threshold value.

29. The non-transitory CRM according to claim 27, further comprising instructions for calculating a flame quality for the first region of interest and a flame quality for the second region of interest by multiplying a first parameter for each respective region of interest with the standard deviation of pixels that are above a set threshold value for each respective region of interest and adding a second parameter for each respective region of interest.

30. The non-transitory CRM according to claim 29, further comprising instructions for calculating the overall flame quality parameter by summing up the products of the flame quality for each respective region of interest and a weight factor for each respective region of interest.

31. The non-transitory CRM according to claim 27, further comprising instructions for comparing the number of pixels that are above a set threshold value of the first region of interest, to the number of pixels that are above the set threshold value of the second region of interest.

32. The non-transitory CRM according to claim 24, further comprising instructions for modifying the overall flame quality parameter by controlling an amount of an additive into the flame based on a control algorithm comprising at least, a user-defined control valve step size parameter for the additive.

* * * * *